US006776723B2

(12) United States Patent
Bliss et al.

(10) Patent No.: US 6,776,723 B2
(45) Date of Patent: Aug. 17, 2004

(54) METAL WOOD GOLF CLUB WITH PROGRESSIVE WEIGHTING

(75) Inventors: John C. Bliss, Glendale, AZ (US); Anthony D. Serrano, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/173,323

(22) Filed: Jun. 17, 2002

(65) Prior Publication Data

US 2003/0232663 A1 Dec. 18, 2003

(51) Int. Cl.[7] ..... A63B 53/00

(52) U.S. Cl. ..... 473/291; 473/314; 473/345; 473/349

(58) Field of Search ..... 473/290, 291, 473/345, 349, 314

(56) References Cited

U.S. PATENT DOCUMENTS

| | | | | | |
|---|---|---|---|---|---|
| 4,043,563 | A | | 8/1977 | Churchward | |
| 4,874,171 | A | * | 10/1989 | Ezaki et al. | 473/290 |
| 5,141,231 | A | * | 8/1992 | Cox | 473/330 |
| 5,398,935 | A | * | 3/1995 | Katayama | 473/349 |
| 5,421,577 | A | * | 6/1995 | Kobayashi | 473/335 |
| 5,518,243 | A | | 5/1996 | Redman | |
| 5,547,188 | A | * | 8/1996 | Dumontier et al. | 473/287 |
| 5,755,624 | A | * | 5/1998 | Helmstetter | 473/291 |
| 5,851,160 | A | | 12/1998 | Rugge et al. | |
| 5,935,020 | A | * | 8/1999 | Stites et al. | 473/345 |
| 6,254,494 | B1 | | 7/2001 | Hasebe et al. | |
| 6,315,678 | B1 | | 11/2001 | Teramoto | |
| 6,340,337 | B2 | * | 1/2002 | Hasebe et al. | 473/349 |
| 6,381,828 | B1 | | 5/2002 | Boyce et al. | |
| 6,409,612 | B1 | | 6/2002 | Evans et al. | |
| 6,440,011 | B1 | | 8/2002 | Hocknell et al. | |

FOREIGN PATENT DOCUMENTS

| | | | |
|---|---|---|---|
| GB | 2327889 | A | 8/1997 |
| JP | 8322970 | A | 12/1996 |
| JP | 2001-17585 | * | 1/2001 |
| JP | 2001-231888 | * | 8/2001 |
| WO | 00/43080 | | 1/2000 |

* cited by examiner

*Primary Examiner*—Stephen Blau
(74) *Attorney, Agent, or Firm*—Darrell F. Marquette

(57) ABSTRACT

A metal wood-type golf club includes a weight member disposed along the interior surface of the bottom wall. The weight member is sized and distributed so as to increase the moment of inertia of the golf club about a vertical axis extending through the center of gravity as well as lowering the center of gravity of the club head itself. The longitudinal position of the weight member is selected as a function of the loft angle of the club face. The weight member is moved forward for a club having a small loft angle and moved rearward for a club having a high loft angle so that the vertical gear effect about the center of gravity partially offsets the natural backspin of the club to a greater or lesser degree depending on the loft angle of the club.

4 Claims, 4 Drawing Sheets

METAL WOOD GOLF CLUB WITH PROGRESSIVE WEIGHTING

BACKGROUND OF THE INVENTION

This invention relates generally to golf clubs and, in particular, to so-called metal wood-type golf clubs.

Golf clubs known as "woods" traditionally have a head made of a suitable wooden material such as maple or persimmon attached to one end of an elongated shaft. These wooden club heads are usually solid and are shaped with their weight properly distributed about their center of gravity to maximize performance. Golf club "wood" heads have also been formed of suitable metals such as stainless steel and titanium. Metal heads are usually hollow. Various attempts have been made to distribute weight in metal heads with respect to their center of gravity so that the performance is maximized. Such attempts have included placing different types and numbers of weight members at different locations inside the metal heads. Examples of such attempts are disclosed in prior U.S. Pat. No. 4,869,507 to Sahm; U.S. Pat. No. 5,058,895 to Igarashi; U.S. Pat. No. 5,141,230 to Antonious; and, U.S. Pat. No. 5,219,408 to Sun.

The Sahm patent teaches that lowering the center of gravity of a club head would tend to add more loft to a golf shot. Igarashi teaches that perimeter weighting increases the moment of inertia of a wood type club. The increased moment of inertia causes the club to resist twisting when a ball is not struck at the "sweet spot", that is, the point on the club face at which a line normal to the face passes through the club head's center of gravity. Reducing the twisting causes the ball to travel with less loss of directional control. None of the aforementioned prior art patents, however, teach use of a weight member to tailor gear effect-induced topspin to partially offset the natural loft angle induced backspin of a metal wood-type club.

SUMMARY OF THE INVENTION

The present invention comprises a metal wood-type golf club comprising a hollow body with a face disposed at a predetermined loft angle adapted for impacting a golf ball. In a preferred embodiment of a golf club, a weight member is disposed along the interior surface of the bottom wall. The weight member is sized and distributed so as to increase the moment of inertia of the golf club about a vertical axis extending through the center of gravity as well as lowering the center of gravity of the club head itself. Additionally, the longitudinal position of the weight member is selected as a function of the loft angle of the club face so that the gear effect about the center of gravity partially offsets the natural backspin of the club. The weight pad is moved forward for a club having a small loft angle and moved rearward for a club having a high loft angle.

Moving the center of gravity fore and aft as a function of loft angle permits clubs to be designed to take advantage of vertical gear effect to tailor the amount of backspin imparted to a golf ball for a given loft angle, thereby enabling the club to deliver the ideal trajectory without over spinning or under spinning the ball.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
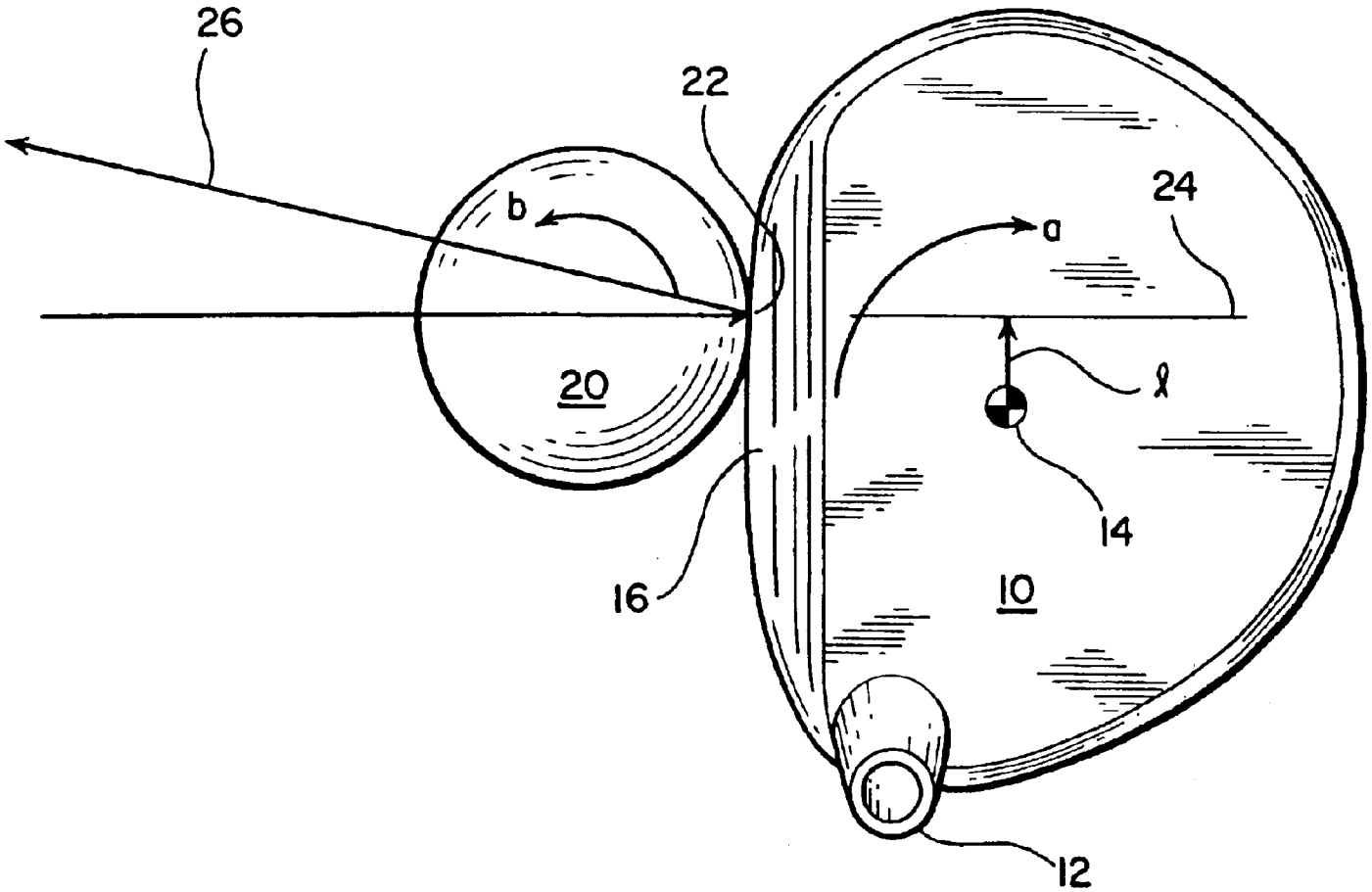
FIG. 1 (PRIOR ART)
FIG. 1 is a top plan view of a prior art golf club head.

The drawing figures are intended to illustrate the general manner of construction and are not necessary to scale. In the detailed description and in the drawing figures, specific illustrative examples are shown and herein described in detail. It should be understood, however, that the drawing figures and the detailed description are not intended to limit the invention to the particular form disclosed but are merely illustrative and intended to teach one of ordinary skill how to make and/or use the invention claimed herein and for setting forth the best mode for carrying out the invention.

FIG. 1 depicts a prior art golf club 10 such as that disclosed in U.S. Pat. No. 5,954,596 to Noble and assigned to the assignee of the present invention. Golf club 10 has a hosel 12, a center of gravity 14, and a face 16. As is well-known in the art, upon impact with a golf ball 20 at a location 22 that is offset from center of gravity 14, club 10 will tend to rotate in the direction of arrow "a" as a result of the torque couple induced by line of action 24 being offset a distance "1" from center of gravity 14. The rotation of club head 10 about center of gravity 14 in the direction of arrow "a" will cause the face 16 of club 10 to open, which will tend to cause ball 20 to fly off of face 16 in direction indicated by arrow 26, which results in a slice type of hit.

As is also well-known in the art, it is possible to design a club head so that the undesirable initial trajectory caused by an off center hit will be at least partially compensated by the so-called "gear effect," which imparts a counteracting spin to the golf ball. As can be seen from FIG. 1, because the rotation of golf club 10 in the direction indicated by arrow "a" is dynamic, for so long as golf ball 20 is in contact with face 16, friction between face 16 and golf ball 20 will cause the surfaces to tend to move together like meshing gears (hence the name gear effect). This coupled movement of surfaces will impart a corresponding spin in the direction indicated by arrow "b" to ball 20. Thus, as can be seen from FIG. 1, in the case of a toe hit, which results in an initial trajectory to the right of the target (for a right handed golfer), the gear effect will impart a hook type spin to the golf ball 20. This spin will tend to cause golf ball 20 to correct somewhat for the initial incorrect trajectory. Similarly, an impact on the hosel side of center of gravity 14 will tend to cause an initial trajectory to the left of the target, with a slice type of spin on golf ball 20 that will correct somewhat for the initial incorrect trajectory. It should be noted that the foregoing discussion takes into account only forces acting in the horizontal plane which tend to open or close the face about a vertical axis extending through center of gravity 14 and imparting spin to golf ball 20 about a vertical axis, which affects the horizontal trajectory of the golf ball.

Accordingly, for the sake of clarity, the forces and reactions discussed with reference to FIG. 1 will be referred to hereinafter as "horizontal gear effect" as opposed to vertical gear effect, which will be discussed in detail hereinafter.

Figure 2:
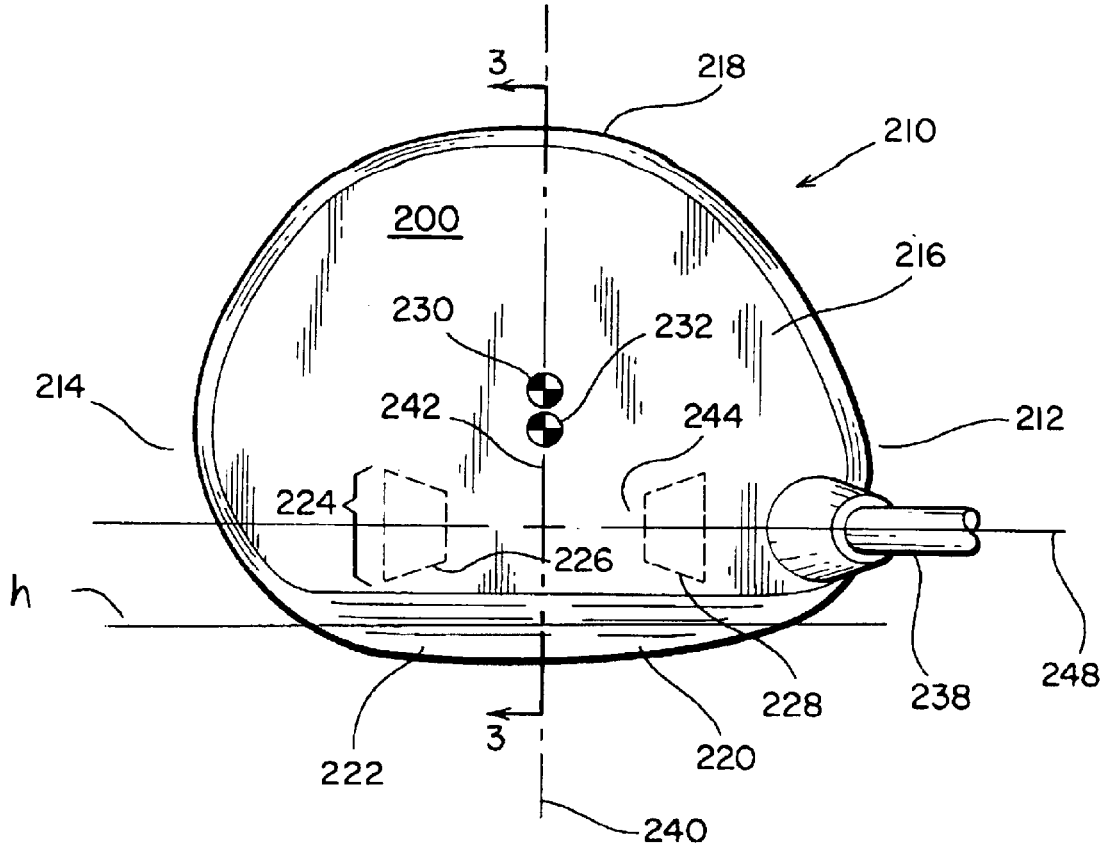
FIG. 2 is a top plan view of a golf club head incorporating features of the present invention.
Figure 3:
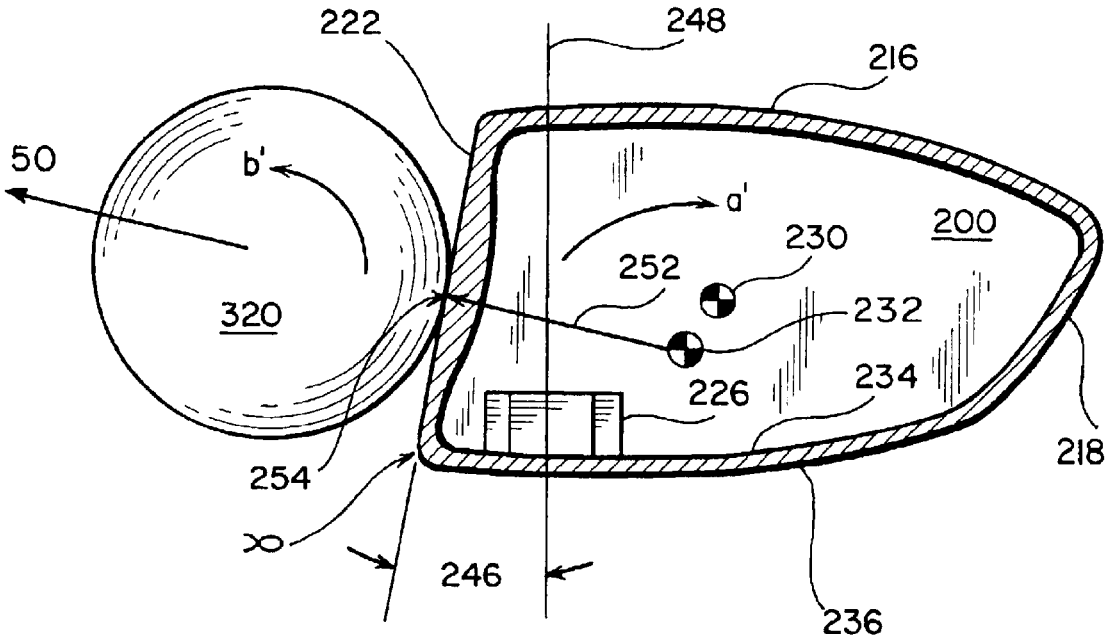
FIG. 3 is a sectional view taken along lines 3—3 of FIG. 2.

Referring to FIGS. 2 and 3, a golf club head 200 incorporating features of the present invention includes a hollow body 210 formed of a suitable metal material such as stainless steel or a titanium alloy having a heel portion 212, a toe portion 214, a top wall 216, a bottom wall 236, a rear wall 218, and a front wall 220 including a face 222 arranged for contacting a golf ball. Club head 200 further includes a weight member 224 composed of individual weight pads 226 and 228 (shown in broken lines in FIG. 2).

Club head 200 has an initial center of gravity 230 which is the center of gravity of the club head without taking into account the mass of weight member 224. Club head 200 also includes a final center of gravity 232 which is the center of gravity of club head 200 taking into account weight member 224. As can be seen from an inspection of FIGS. 2 and 3 the effect of the addition of weight member 224 to club head 200 is to move the center of gravity lower and further forward. Weight pads 226 and 228 each comprise trapezoidal parallelepipeds formed at a suitable metal material such as stainless steel, zirconium titanium or alloys of zirconium or titanium extending upward from inner surface 234 of bottom wall 236 of club head 200. The shape and orientation of weight pads and 226 and 228 (trapezoidal parallelepipeds having a long axis parallel to the longitudinal axis 240, and having their respective short parallel sides 242 and 244 nearest center of gravity 232) is dictated by a desire to maximize the moment of inertia of weight member 224 about a vertical axis extending through center gravity 232 while still moving the center of gravity downward and forward in accordance with the present invention.

With reference to FIG. 3, face 222 of club head 200 is inclined at a loft angle 246 with respect to a first vertical plane 248 containing the longitudinal axis of shaft 238 and parallel to a horizontal line "h," which is tangent to face 222 at its center and thus defines an idealized "plane" of face 222 (face 222 in reality having both bulge and roll rending it less than a pure planar surface). Accordingly as used herein in connection with defining the angular orientation of the vertical plane containing the longitudinal axis of the shaft relative to the face, the "plane" of the club face means the vertical plane containing line "h." As face 222 strikes golf ball 320, loft angle 246 causes golf ball 320 to be launched at an initial upward trajectory 250. Simultaneously, the inertial effect of golf ball 320 striking the inclined face 222 imparts a backspin (opposite the direction of arrow b') on golf ball 320. What the inventors of the present invention discovered, however, is that simultaneously, the dynamic forces acting on club head 200 striking golf ball 320 cause club head 200 to rotate about its center of gravity 232 in a face-up direction as indicated in arrow a' in FIG. 3. It was determined that this dynamic face-up rotation could be utilized to moderate the backspin imparted to golf ball 320 by adding a topspin component to the club-ball interaction, and that this effect could be tailored by moving the center of gravity of the club head 200 laterally forward and backward as a function of loft angle 246.

As illustrated in FIG. 3, as club head 200 rotates about its center of gravity in the direction a', for so long as golf ball 320 is in contact with face 222, friction between the contacting surfaces of face 222 and golf ball 320 causes the surfaces to move together. Accordingly, rotation of golf club head 200 about its center of gravity 232 imparts an opposite rotation in the direction of arrow b' to golf ball 320. This is a similar mechanism to the horizontal gear effect discussed with reference to FIG. 1, however, the rotation of club head 200 is about a horizontal axis passing through center of gravity 232 and the rotation of golf ball 320 is about a horizontal axis passing through its center of gravity. The spin thus imparted to golf ball 320 affects the vertical trajectory of golf ball 320. Accordingly, the interaction between face 222 and golf ball 320 is referred to herein as the "vertical gear effect" to distinguish it from the horizontal gear effect previously discussed.

As shown in FIGS. 2 and 3, placement of weight member 224 comprising weight pads 226 and 228 causes the center of gravity of club head 200 to move from the location indicated by initial center of gravity 230 to the position indicated by final center of gravity 232. In the illustrative embodiment, loft angle 246 is about 14° and the final center of gravity 232 is about 0.040 inches forward and 0.025 inches below initial center of gravity 230. Since the moment arm 252 from final center of gravity 232 to impact point 254 is shorter than the moment arm from initial center of gravity 230 to impact point 254, for a given rate of angular velocity ω the surface speed at impact point 254 is less with the center of gravity located at final center of gravity 232 than with initial center of gravity 230. Accordingly, relocating the center of gravity further forward reduces the vertical gear effect induced topspin component to the rotation of golf ball 320 leaving face 222. Accordingly, golf ball 320 has more backspin then it would if the center of gravity were located at initial center of gravity 230. This is appropriate for clubs having relatively modest loft such as a three wood having a loft angle of between 11° and 16° as shown in FIG. 3.

Figure 4:
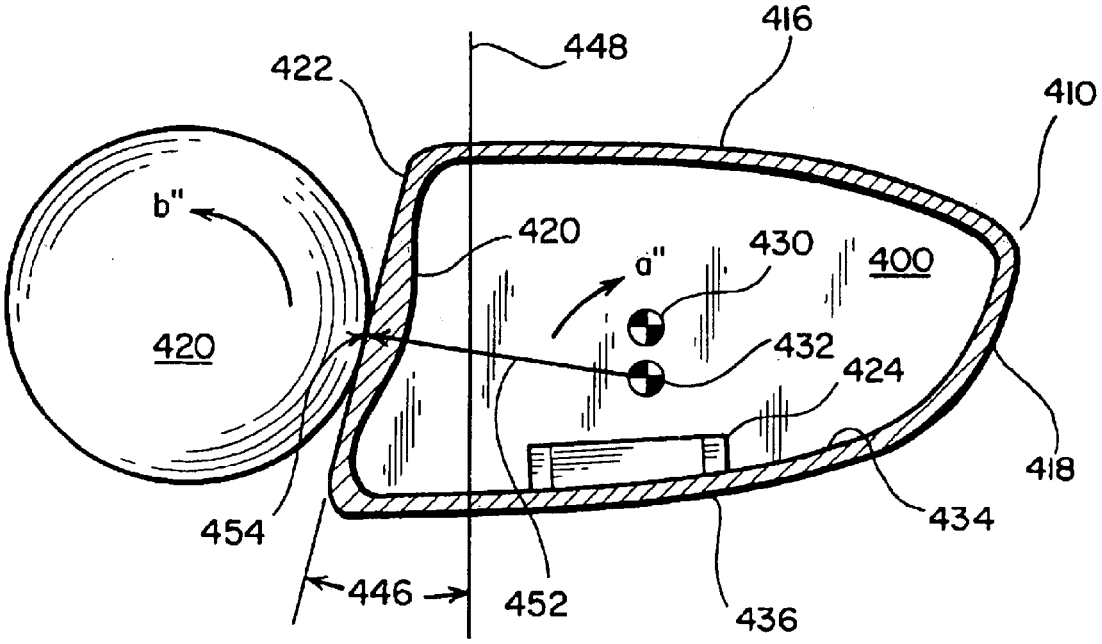
FIG. 4 is a sectional view of a golf club head incorporating features of the present invention having an increased loft angle.
Figure 6:
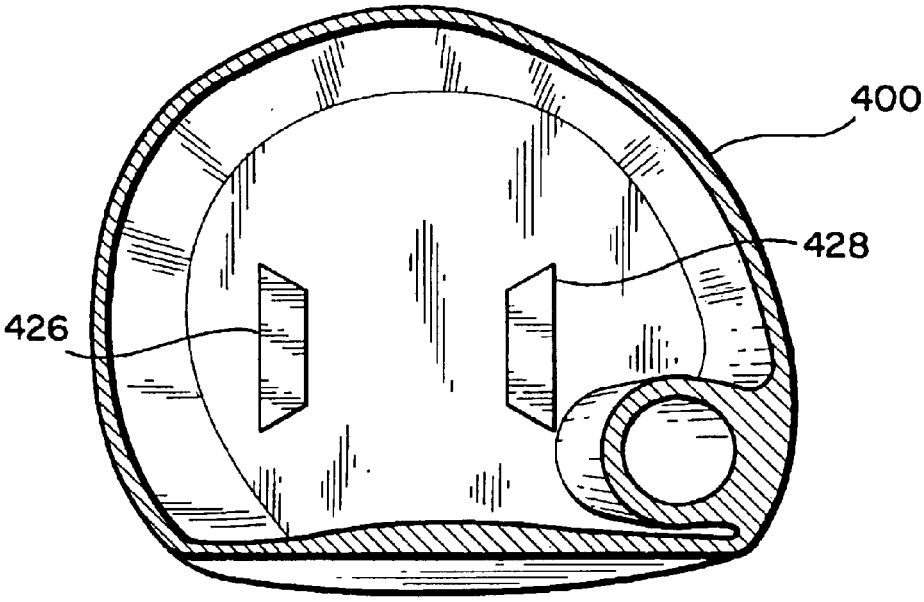
FIG. 6 is a top sectional view of the golf club head of FIG. 4.

With reference to FIGS. 4 and 6, club head 400 comprises a hollow body 410 having a top wall 416, bottom wall 436, rear wall 418, and front wall 420 including a face 422 for impacting a golf ball. Face 422 is inclined at a loft angle 446 with respect to a vertical plane 448 parallel to face 422 and containing the longitudinal axis of golf club shaft 248. Loft angle 446 is greater than loft angle 246 of club head 200. Weight member 424 comprising weight pads 426 and 428 is disposed on inner surface 434 of bottom wall 436. Weight member 424 is sized and positioned so as to move the center of gravity of club head 400 from a position indicated by initial center of gravity 430 to a position indicated by final center of gravity 432. In the illustrative embodiment of FIG. 4, loft angle 446 is approximately 17° and the final center of gravity 432 is approximately 0.020 inches forward of initial center of gravity 430 and approximately 0.026 inches below initial center of gravity 430. As with the embodiment of FIG. 3, loft angle 446 of club head 400 imparts an initial trajectory and an initial backspin to golf ball 420 upon impact. The dynamic forces acting on club head 400 cause it to rotate in a direction indicated by arrow a" about final center of gravity 432. The frictional contact between the contacting surfaces of golf ball 420 and club head 400 at impact point 454 causes the surfaces to move together thus imparting a vertical gear effect topspin component indicated by arrow b" in golf ball 420. Because the moment arm 452 between final center of gravity 432 and impact point 454 is slightly shorter then the moment arm from initial center of gravity 430 to impact point 454, for a given angular velocity ω, the vertical gear effect induced top spin component is slightly less than if the center of gravity were located at initial center of gravity 430. Accordingly, the backspin imparted to golf ball 420 will be slightly less then if weight member 424 were not present. This is appropriate for a golf club having moderate loft such as a five wood having a loft angle of from 16° to 18°.

Figure 5:
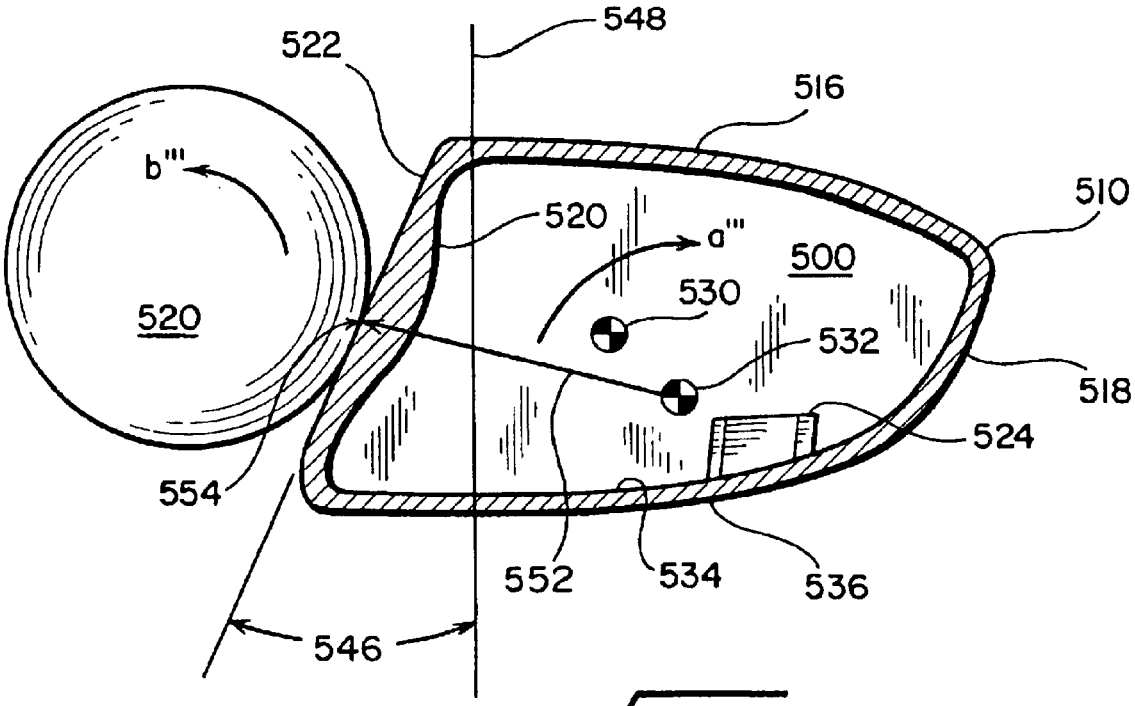
FIG. 5 is a sectional view of a golf club head incorporating features of the present invention having a still further increased loft angle.
Figure 7:
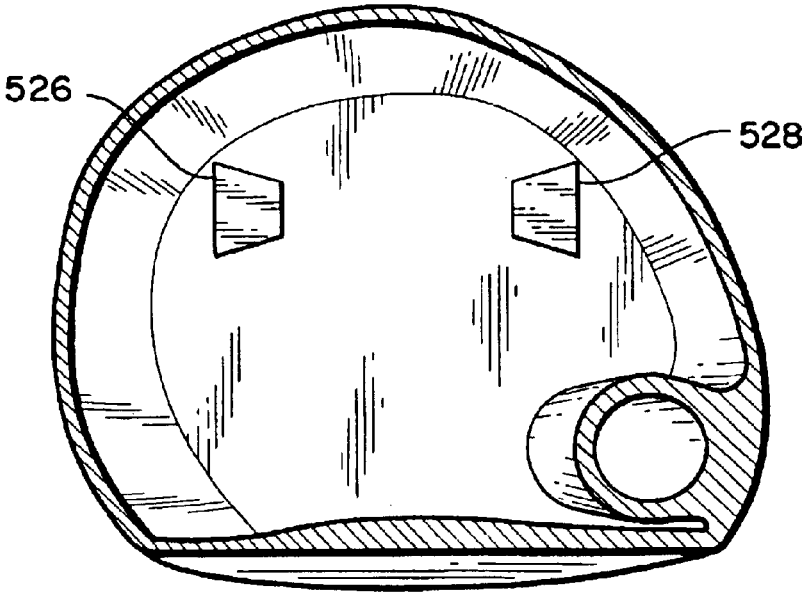
FIG. 7 is a sectional view of the golf club head of FIG. 5.

With reference to FIGS. 5 and 7, a golf club head 500 comprises a hollow body 510 having a top wall 516, a bottom wall 536, a rear wall 518, and a front wall 520 including a face 522. Face 522 is inclined at a loft angle 546 with respect to a vertical plane 548 parallel to face 522 and containing the longitudinal axis of golf club shaft 238. Loft angle 546 is greater than either loft angle 446 or loft angle 246. Upon impact between club head 500 and golf ball 520, inclined face 522 imparts an initial trajectory and backspin to golf ball 520. The dynamic forces of impact also cause club head 500 to rotate in a direction indicated by arrow a''' about final center of gravity 532. For so long as golf ball 520 is in contact with face 522, the contacting surfaces move together and the vertical gear effect induces a corresponding rotational component indicated by arrow b''' which tends to counteract the face-induced backspin in golf ball 520. Weight member 524, composed of weight pads 526 and 528 is attached to inner surface 534 of bottom wall 536 and is sized and positioned so as to move the center of gravity of club head 500 from the position indicated by initial center of gravity 530 to the position indicated by final center of gravity 532. In an illustrative embodiment, loft angle 546 is approximately 20° and weight member 524 is sized and positioned so as to move the center of gravity of club head 500 rearward approximately 0.020 inches and downward approximately 0.01 inches. Because moment arm 552 from final center of gravity 532 to impact point 554 is longer than the moment arm from initial center of gravity 530 to impact point 554, for a given angular velocity ω, the surface speed at impact 554 is greater with the center of gravity of club head 500 at final center of gravity 532 then with the center of gravity at initial center of gravity 530. Accordingly, the vertical gear effect induced topspin component is greater with weight member 524 present than without. Accordingly, club head 500 produces less back spin with weight member 524 present and the center of gravity located at final center of gravity 532 than with weight member 524 absent and center of gravity located at initial center of gravity 530. This is appropriate for clubs having substantial loft such as a 7 wood having a loft angle of from 18° to 22°.

By tailoring the location of the center of gravity in the fore and aft direction as a function of the loft angle of the club, a hollow metal wood-type club incorporating features of the present invention is capable of delivering the ideal trajectory without overspinning or under spinning the ball.

Although certain illustrative embodiments and methods have been disclosed herein, it will be apparent from the foregoing disclosure to those skilled in the art that variations and modifications of such embodiments and methods may be made without departing from spirit and scope of the invention. Accordingly, it is intended that the invention should be limited only to the extent required by the appended claims and the rules and principals of applicable law.

What is claimed is:

1. A set of golf clubs comprising:

a first club and a second club, said first club comprising;

a first elongated shaft having a grip end and a hosel end;

a first golf club head attached to the hosel end of said first elongated shaft;

said first golf club head comprising a hollow body having a heel portion, a toe portion, a top wall, a bottom wall, and a front wall; and a first weight member disposed at a predetermined location on said first golf club head;

said front wall of said first golf club head including a first face adapted for impacting a golf ball, said first face disposed at a first predetermined loft angle;

said first golf club head having a center of gravity located rearward of said first face and below said top wall of said first golf club head, said second club comprising;

a second elongated shaft having a grip end and a hosel end;

a second golf club head attached to the hosel end of said second elongated shaft;

said second golf club head comprising a hollow body having a heel portion, a toe portion, a top wall, a bottom wall, and a front wall; and a second weight member disposed at a predetermined location on said second golf club head;

said front wall of said second golf club head including a second face adapted for impacting a golf ball, said second face disposed at a second predetermined loft angle, said second predetermined loft angle being greater than said first predetermined loft angle;

said second golf club head having a center of gravity located rearward of said second face and below said top wall of said second golf club head, said first and second weight members being disposed such that the distance from said center of gravity of said first golf club head to said first face is less than the distance from said center of gravity of said second golf club head to said second face, whereby the second club in said set of clubs has greater loft angle and a center of gravity located further rearward than the first club;

said set of golf clubs further comprising;

a third club, said third club comprising;

a third elongated shaft having a grip end and a hosel end;

a third golf club head attached to the hosel end of said third elongated shaft;

said third golf club head comprising a hollow body having a heel portion, a toe portion, a top wall, a bottom wall, and a front wall; and a third weight member disposed at a predetermined location on said third golf club head;

said front wall of said third golf club head including a third face adapted for impacting a golf ball, said third face disposed at a third predetermined loft angle, said third predetermined loft angle being greater than said second predetermined loft angle;

said third golf club head having a center of gravity located rearward of said third face and below said top wall of said third golf club head, said third weight member being disposed such that the distance from said center of gravity of said second golf club head to said second face is less than the distance from said center of gravity of said third golf club head to said third face, wherein said first golf club head comprises a three-wood and said third golf club head comprises a seven-wood, said three-wood comprising a three wood club head body having a loft angle of from eleven to sixteen degrees and center of gravity located no more than 1.41 inches behind the forwardmost point of said three-wood club head body, said seven-wood comprising a seven-wood club head body having a loft angle of from eighteen to twenty-two degrees and a center of gravity located at least 1.42 inches behind the forwardmost point of said seven-wood club head body.

2. A set of metal wood-type golf clubs comprising:

a plurality of club heads each comprising a hollow body-having a heel portion, a toe portion, a top wall, a bottom wall, and a front wall extending between said top wall and said bottom wall, each of said plurality of club heads including a face disposed at a predetermined loft angle adapted for impacting a golf ball;

each of said plurality of club heads further having a center of gravity;

said plurality of club heads formed such that the center of gravity of each of said plurality of club heads is disposed further rearward as said predetermined loft angle increases, wherein said plurality of club heads comprise a three-wood and a seven-wood, said three-wood comprising a three wood club head body having a loft angle of from thirteen to fifteen degrees and center of gravity located no more than 1.41 inches behind the forwardmost point of said three-wood club head body, said seven-wood comprising a seven-wood club head body having a loft angle of from nineteen to twenty-one degrees and a center of gravity located at least 1.42 inches behind the forwardmost point of said seven-wood club head body.

3. A set of golf clubs comprising:

a first club and a second club, said first club comprising;

a first elongated shaft having a grip end and a hosel end;

a first golf club head attached to the hosel end of said first elongated shaft;

said first golf club head comprising a hollow body having a heel portion, a toe portion, a top wall, a bottom wall, and a front wall; and a first weight member disposed at a predetermined location on said first golf club head;

said front wall of said first golf club head including a first face adapted for impacting a golf ball, said first face disposed at a first predetermined loft angle;

said first golf club head having a center of gravity located rearward of said first face and below said top wall of said first golf club head, said second club comprising;

a second elongated shaft having a grip end and a hosel end;

a second golf club head attached to the hosel end of said second elongated shaft;

said second golf club head comprising a hollow body having a heel portion, a toe portion, a top wall, a bottom wall, and a front wall; and a second weight member disposed at a predetermined location on said second golf club head;

said front wall of said second golf club head including a second face adapted for impacting a golf ball, said second face disposed at a second predetermined loft angle, said second predetermined loft angle being greater than said first predetermined loft angle;

said second golf club head having a center of gravity located rearward of said second face and below said top wall of said second golf club head, said first and second weight members being disposed such that the distance from said center of gravity of said first golf club head to said first face is less than the distance from said center of gravity of said second golf club head to said second face, whereby the second club in said set of clubs has greater loft angle and a center of gravity located further rearward than the first club;

said set of golf clubs further comprising;

a third club, said third club comprising;

a third elongated shaft having a grip end and a hosel end;

a third golf club head attached to the hosel end of said third elongated shaft;

said third golf club head comprising a hollow body having a heel portion, a toe portion, a top wall, a bottom wall, and a front wall; and a third weight member disposed at a predetermined location on said third golf club head;

said front wall of said third golf club head including a third face adapted for impacting a golf ball, said third face disposed at a third predetermined loft angle, said third predetermined loft angle being greater than said second predetermined loft angle;

said third golf club head having a center of gravity located rearward of said third face and below said top wall of said third golf club head, said third weight member being disposed such that the distance from said center of gravity of said second golf club head to said second face is less than the distance from said center of gravity of said third golf club head to said third face, wherein said first golf club head comprises a three-wood and said third golf club head comprises a five-wood, said three-wood comprising a three wood club head body having a loft angle of from eleven to sixteen degrees and said five-wood comprising a five-wood club head body having a loft angle of from sixteen to eighteen degrees.

4. A set of metal wood-type golf clubs comprising:

a plurality of club heads each comprising a hollow body having a heel portion, a toe portion, a top wall, a bottom wall, and a front wall extending between said top wall and said bottom wall, each of said plurality of club heads including a face disposed at a predetermined loft angle adapted for impacting a golf ball;

each of said plurality of club heads further having a center of gravity;

said plurality of club heads formed such that the center of gravity of each of said plurality of club heads is disposed further rearward as said predetermined loft angle increases, wherein said plurality of club heads comprise a three-wood and a five-wood, said three-wood comprising a three wood club head body having a loft angle of from thirteen to fifteen degrees and said five-wood comprising a five-wood club head body having a loft angle of from sixteen to eighteen degrees.

* * * * *